US005575191A

United States Patent [19]

Wang

[11] Patent Number: 5,575,191

[45] **Date of Patent: *Nov. 19, 1996**

[54] SAW EQUIPMENT

[76] Inventor: Mary Wang, No.20, Alley 22, Lane 294, Sec.3, Chang-Shui Rd., Hsi-Hu Chen, Chang-Hua Hsien, Taiwan

[ * ] Notice: The term of this patent shall not extend beyond the expiration date of Pat. No. 5,392,679.

[21] Appl. No.: 254,245

[22] Filed: Jun. 6, 1994

[51] Int. Cl.[6] ..... B27B 21/02

[52] U.S. Cl. ..... 83/766; 83/767; 83/699.51

[58] Field of Search ..... 83/764, 766, 767, 83/699.51, 699.31, 471.3, 477.1, 581

[56] References Cited

U.S. PATENT DOCUMENTS

| | | | |
|---|---|---|---|
| 760,982 | 5/1904 | Gordon | 83/766 |
| 1,063,113 | 5/1913 | Bremer | 83/766 X |
| 1,075,730 | 10/1913 | Ross | 83/766 X |
| 1,235,970 | 8/1917 | Guth | 83/766 X |
| 1,259,380 | 3/1918 | Eagleson | 83/766 |
| 1,447,417 | 3/1923 | Johnson | 83/766 |
| 1,541,134 | 6/1925 | Gilpin | 83/766 |
| 1,653,386 | 12/1927 | Beyland | 83/766 |
| 1,910,383 | 5/1933 | Eitniear | 83/766 |
| 3,948,136 | 4/1976 | Gutowski et al. | 83/767 |
| 5,259,284 | 11/1993 | Chen | 83/766 X |
| 5,392,679 | 2/1995 | Wang | 83/766 |

*Primary Examiner*—Rinaldi I. Rada
*Assistant Examiner*—Raymond D. Woods
*Attorney, Agent, or Firm*—Baker & Daniels

[57] ABSTRACT

A saw equipment includes a working table, a rotary arm unit, a hacksaw, two guide units, two adjusting members, and two locking units. The rotary arm unit includes a rotary arm mounted pivotally on the working table, and two upright positioning plates respectively secured to two end portions of the rotary arm. Each of the positioning plates has a plurality of angularly equidistant engaging holes formed therein. The guide units are capable of holding and guiding the hacksaw. The adjusting members are connected respectively to the guide units. Each adjusting member has a lock block movably contacting a respective one of the positioning plates. Each lock block has an engaging nose projecting therefrom to engage removably and selectively one of the engaging holes of a corresponding one of the positioning plates for adjustment of an inclining angle of the hacksaw relative to a horizontal plane. Each of the locking units is capable of locking each of the adjusting members releasably on a respective one of the positioning plates of the rotary arm unit, and is operable to release the adjusting member to permit removal of the engaging nose from the engaging hole.

7 Claims, 8 Drawing Sheets

SAW EQUIPMENT

BACKGROUND OF THE INVENTION

1. Field of the Invention

This invention relates to a saw equipment, more particularly to a saw equipment which has two adjusting members for adjusting conveniently the angle of a saw blade of the saw equipment relative to a horizontal plane.

2. Description of the Related Art

This invention is an improvement of a conventional saw equipment 10, as shown in FIG. 1, which includes a working table unit 11, an adjusting unit 12 mounted pivotally on the working table unit 11, two connecting rod devices 14 disposed on two end portions of the adjusting unit 12, and a hacksaw 13 connected to the connecting rod devices 14.

The working table unit 11 has a middle plate 111, two scale plates 112 mounted respectively and securely on two opposite sides of the middle plate 111, and two support brackets 113 respectively secured to the bottom sides of the bottom ends of the scale plates 112. The adjusting unit 12, as shown in FIG. 2, includes a rotary arm 121, two retaining members 122 respectively secured to two ends of the rotary arm 121, and two generally U-shaped rotary saw supports 123 retained respectively and rotatably within the retaining members 122. The rotary arm 121 has a middle section mounted pivotally on the bottom side of the middle plate 111. A lock element 124 extends from a side wall of the middle section of the rotary arm 121 so as to lock the rotary arm 121 on the working table unit 11. An actuator plate 125 is mounted on the bottom side of the rotary arm 121 so as to facilitate the rotation of the rotary arm 121 when the rotary arm 121 is unlocked from the working table unit 11. Each of the retaining members 122 has several positioning holes 1221 formed therein and a curved surface 1222 formed in the outside wall of the retaining member 122 so as to mount the rotary saw support 123 thereon. Each of the rotary saw supports 123 has a hole 128 selectively aligned with one of the positioning holes 1221 of the corresponding one of the retaining members 122. A spring-loaded pin 126 extends through the hole 128 of the rotary saw support 123 to engage one of the positioning holes 1221 of the corresponding one of the retaining members 122 so as to position the rotary saw support 123 on the retaining member 122. Two bolts 127 engage two holes respectively, which holes are formed in the retaining member 122 on two sides of the curved surface 1222, in order to retain the rotary saw support 123 within the retaining member 122. Each of the rotary saw supports 123 further has a blind hole 1231 formed at an upper portion for positioning a respective one of the connecting rod devices 14 therein such that the connecting rod devices 14 extend upwardly from the rotary saw supports 123.

When it is desired to adjust the angle of the saw blade of the hacksaw 13 relative to the top surface of the middle plate 111, the bolts 127 must be removed from a respective one of the retaining members 122. At this time, the spring-loaded pins 126 are respectively pulled out of the positioning holes 1221 in the retaining members 122. In this way, the rotary saw supports 123 are capable of being rotated relative to the retaining member 122 to a selected angle, thereby locating the saw blade of the hacksaw 13 in an inclined position, as shown in FIG. 3. Then, the spring-loaded pins 126 are released to engage another positioning hole 1221 of a respective one of the retaining members 122 so as to position the rotary saw support 123 at a predetermined location on the retaining member 122.

The above-mentioned adjusting process suffers from the following disadvantages:

(1) Because the rotary saw supports 123 must be rotated simultaneously, it is difficult for the user to pull the spring-loaded pin 126 and to rotate the corresponding rotary saw support 123 with only one hand.

(2) When the hacksaw 13 is operated to saw wood, sawdust easily deposits on the curved surfaces 1222 of the retaining members 122, thus causing some difficulty in the rotation of the rotary saw supports 123.

Other related devices are disclosed in U.S. Pat. Nos. 1,063,113, 1,075,730, 1,096,072, 1,235,970, 1,259,380, 1,447,417, 1,653,386, and 1,910,383.

SUMMARY OF THE INVENTION

Therefore, the main object of this present invention is to provide a saw equipment which has two adjusting members for adjusting conveniently the angle of the saw blade of the saw equipment relative to a horizontal plane.

According to this invention, a saw equipment includes a working table, a rotary arm unit, a hacksaw, two guide units, and two adjusting members. The working table has a segmental plate and a rotary axis at a center of the segmental plate. The rotary arm unit is rotatable about the rotary axis of the segmental plate and includes a rotary arm which has an intermediate portion that is mounted rotatably on the rotary axis of the working table, and two upright positioning plates which are respectively secured to top surfaces of two end portions of the rotary arm. Each of the positioning plates has a generally V-shaped notch formed in an upper end portion thereof, and a plurality of angularly equidistant engaging holes formed in the positioning plate and circumferentially aligned with each other. The hacksaw includes a saw blade and a frame which is removably connected to two end portions of the saw blade so as to facilitate operation of the hacksaw. The guide units are capable of holding and guiding the hacksaw above the working table. Each of the adjusting members mounts adjustably each of said guide units to a respective one of the positioning plates, and has a lock block movably contacting a respective one of the positioning plates. Each of the lock blocks has an engaging nose projecting therefrom to engage removably and selectively one of the engaging holes of a corresponding one of the positioning plates for adjustment of an inclining angle of the hacksaw relative to a horizontal plane. The saw equipment further includes locking means for locking the adjusting members releasably to the positioning plates of the rotary arm unit. The locking means is operable to release the adjusting members to permit removal of the engaging noses from the engaging holes.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
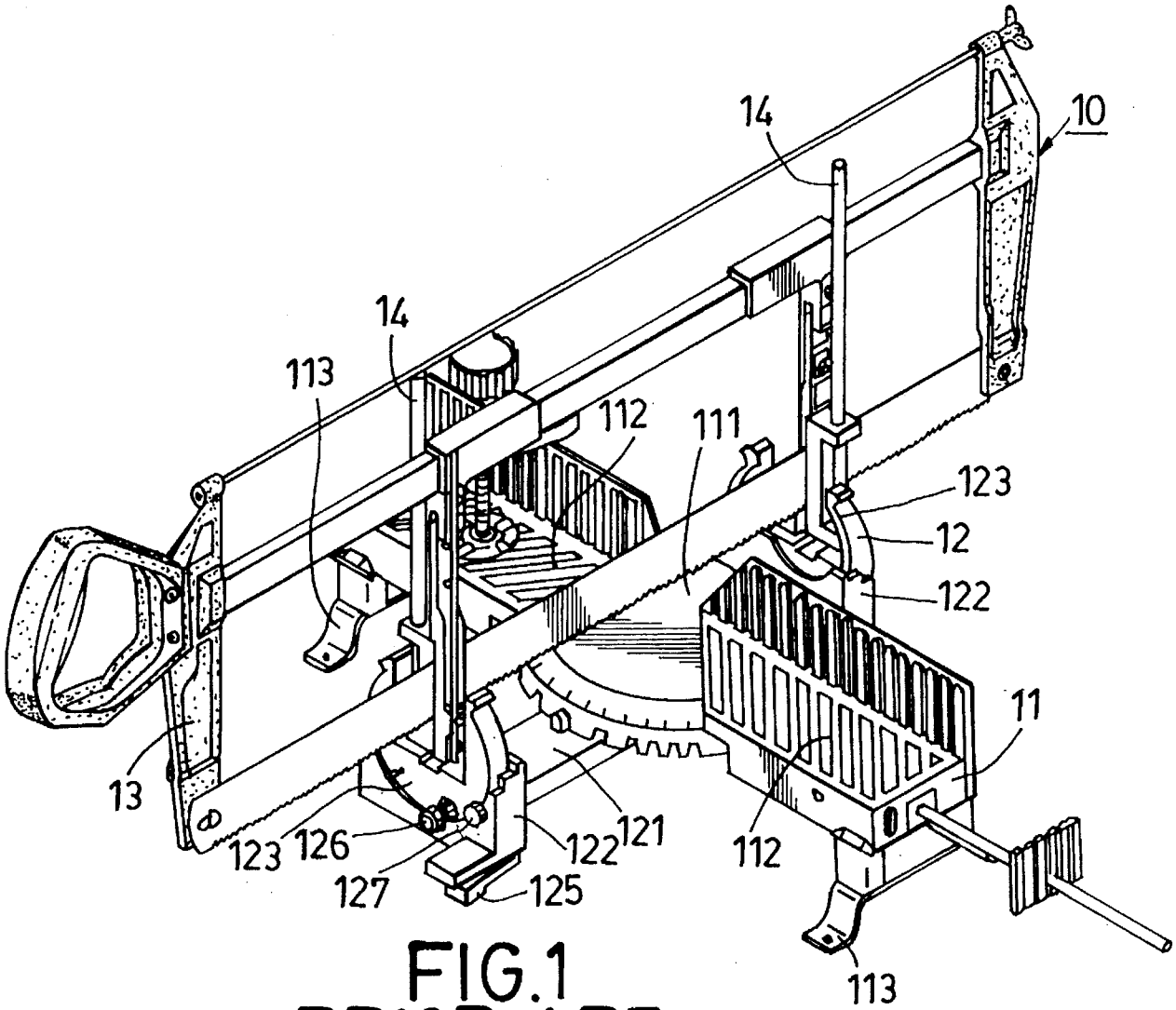
FIG. 1 PRIOR ART
FIG. 1 is a perspective view of a conventional saw equipment.
Figure 2:
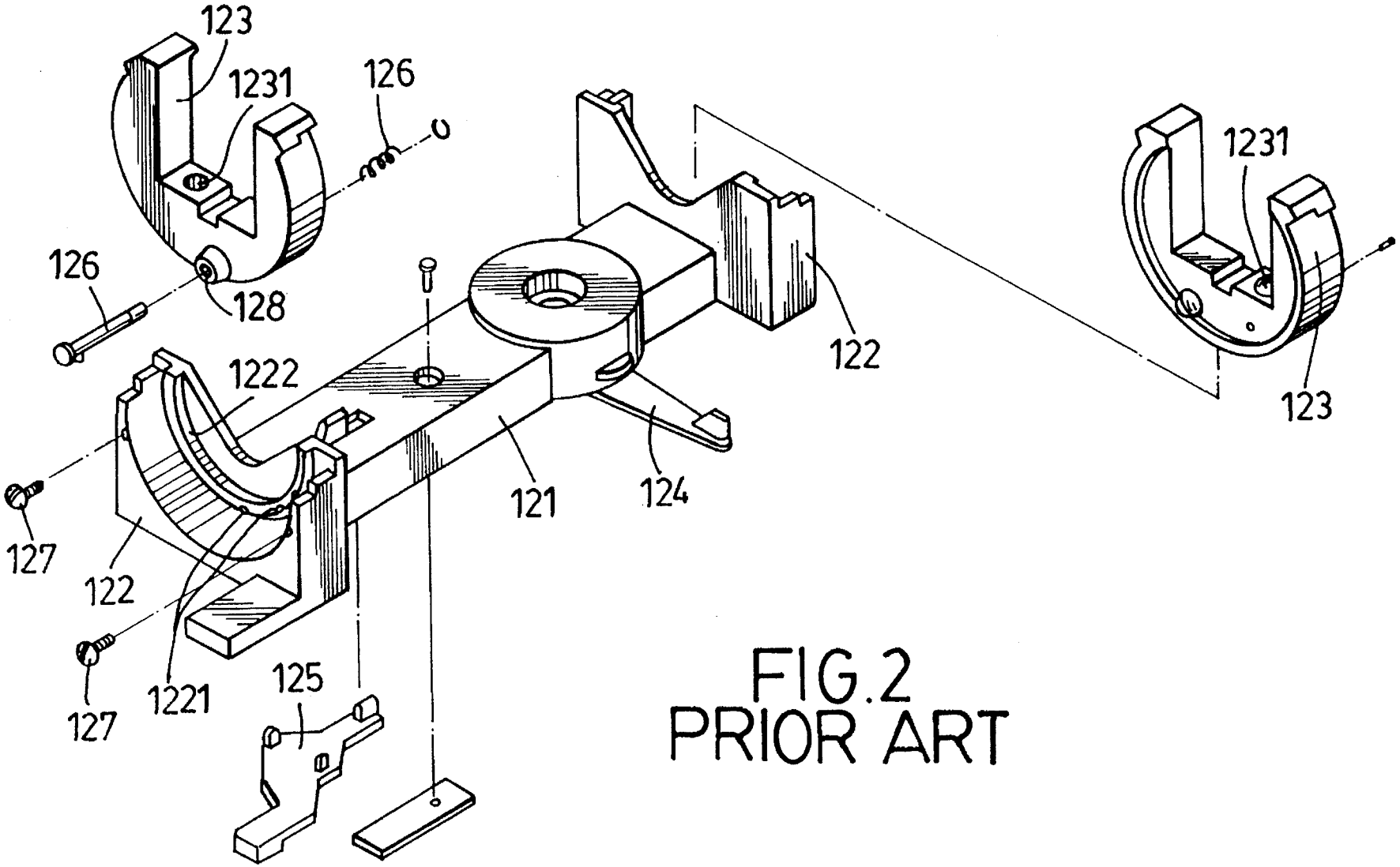
FIG. 2 PRIOR ART
FIG. 2 is an exploded view showing an adjusting unit of the conventional saw equipment.
Figure 3:
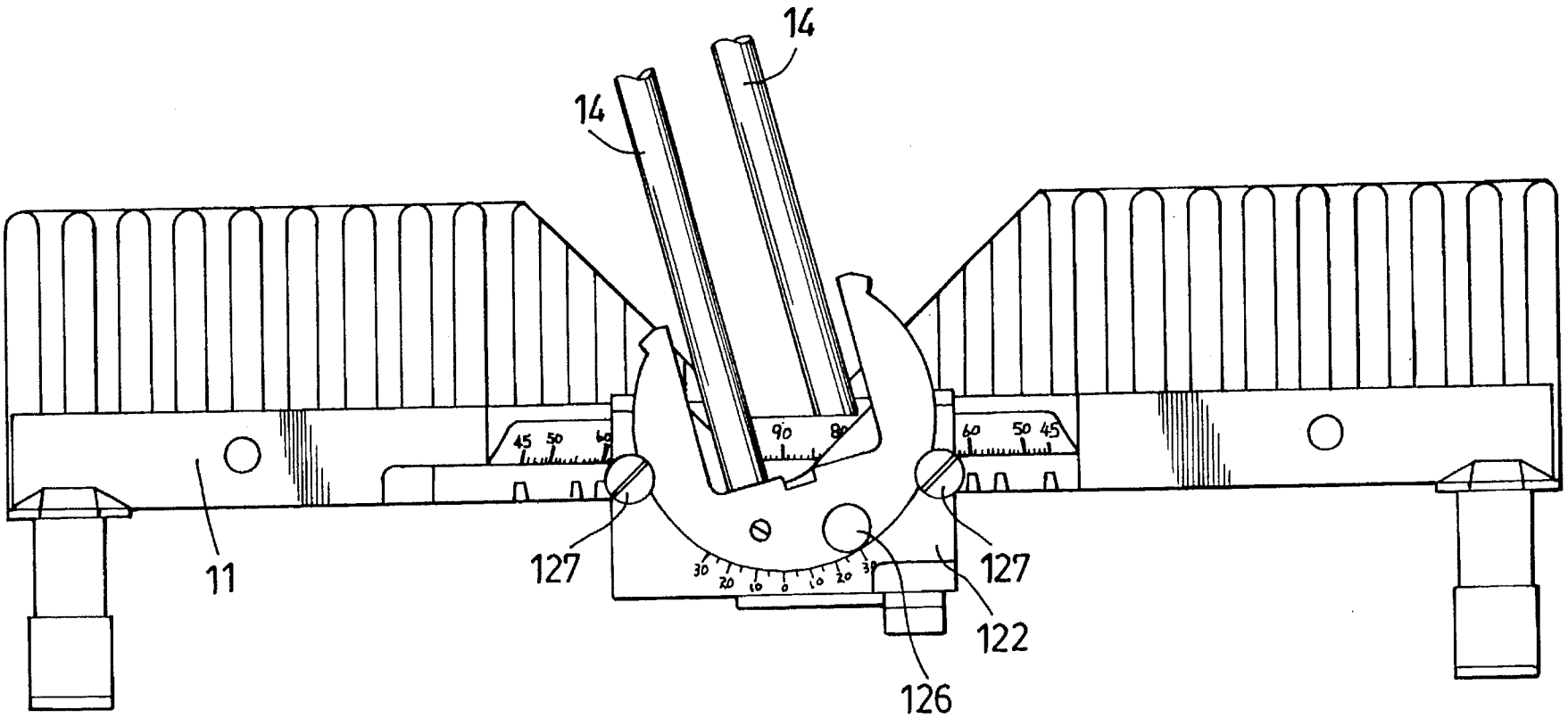
FIG. 3 PRIOR ART
FIG. 3 is a schematic view illustrating the rotation of the adjusting unit of the conventional saw equipment.
Figure 4:
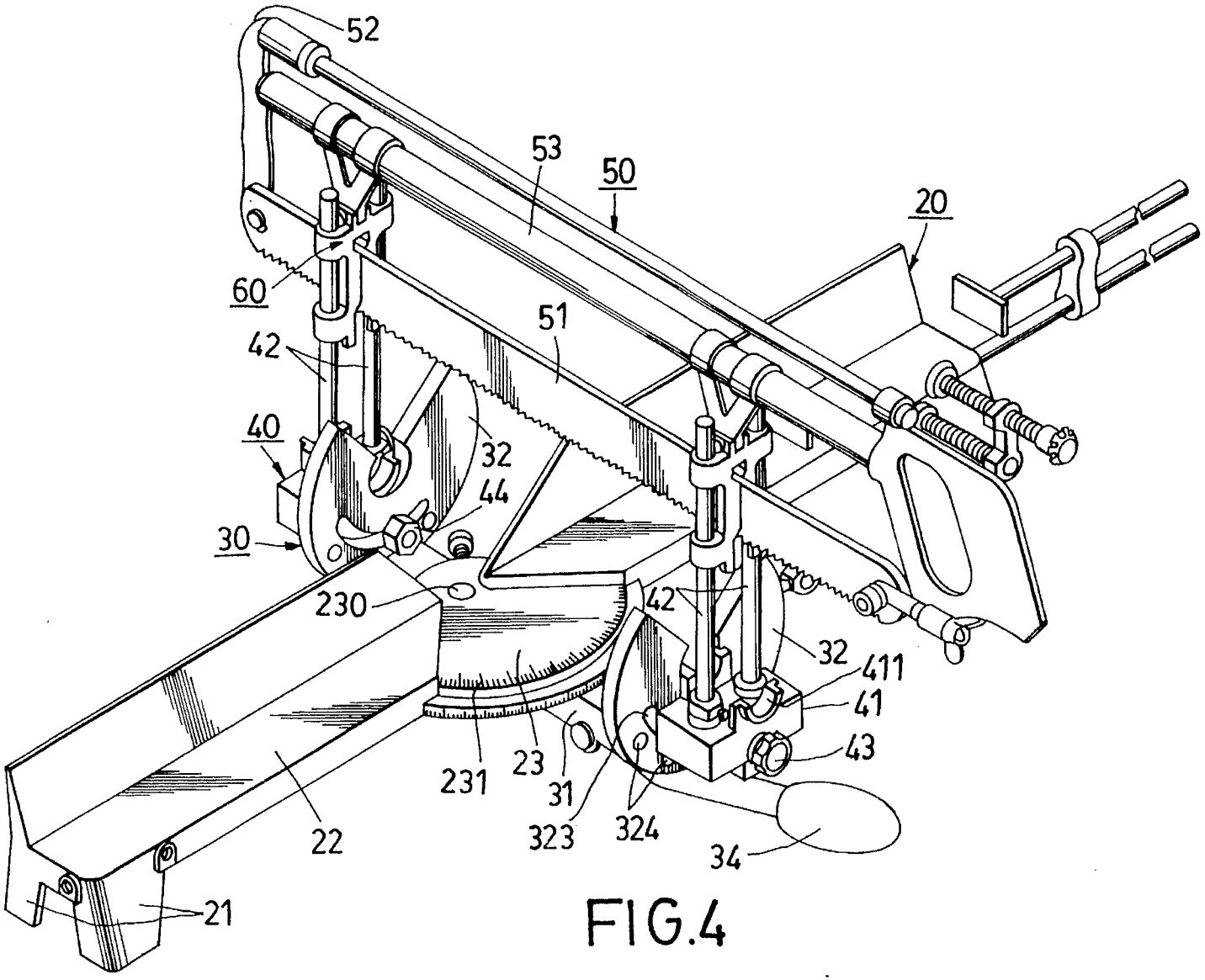
FIG. 4 is a perspective view showing a saw equipment of the preferred embodiment of this invention.

Referring to FIG. 4, a saw equipment of the preferred embodiment of this invention includes a working table 20, a rotary arm unit 30, two adjusting members 40, a hacksaw 50, and two guide units 60.

The working table 20 has a segmental plate 23, two supporting plates 22 mounted respectively and securely on two opposite sides of the segmental plate 3 for receiving wood thereon, and two supporting brackets 21 respectively secured to the bottom surfaces of the distal ends of the supporting plates 22. The segmental plate 23 has a rotary axis at a center portion 230 thereof, and a set of angle-measuring marks 231 formed on the peripheral portion of the top surface thereof.

The hacksaw 50 includes a saw blade 51 and a frame 52 which is removably connected to two end portions of the saw blade 51 so as to facilitate operation of the hacksaw 50. The frame 52 has a horizontal bar 53 located above the saw blade 51.

The rotary arm unit 30 includes a rotary arm 31 with an intermediate portion connected pivotally to the bottom surface of the center portion 230 of the segmental plate 23 of the working table 20 in a known manner, and two upright positioning plates 32 which are secured respectively to the top surfaces of two end portions of the rotary arm 31.

Figure 5:
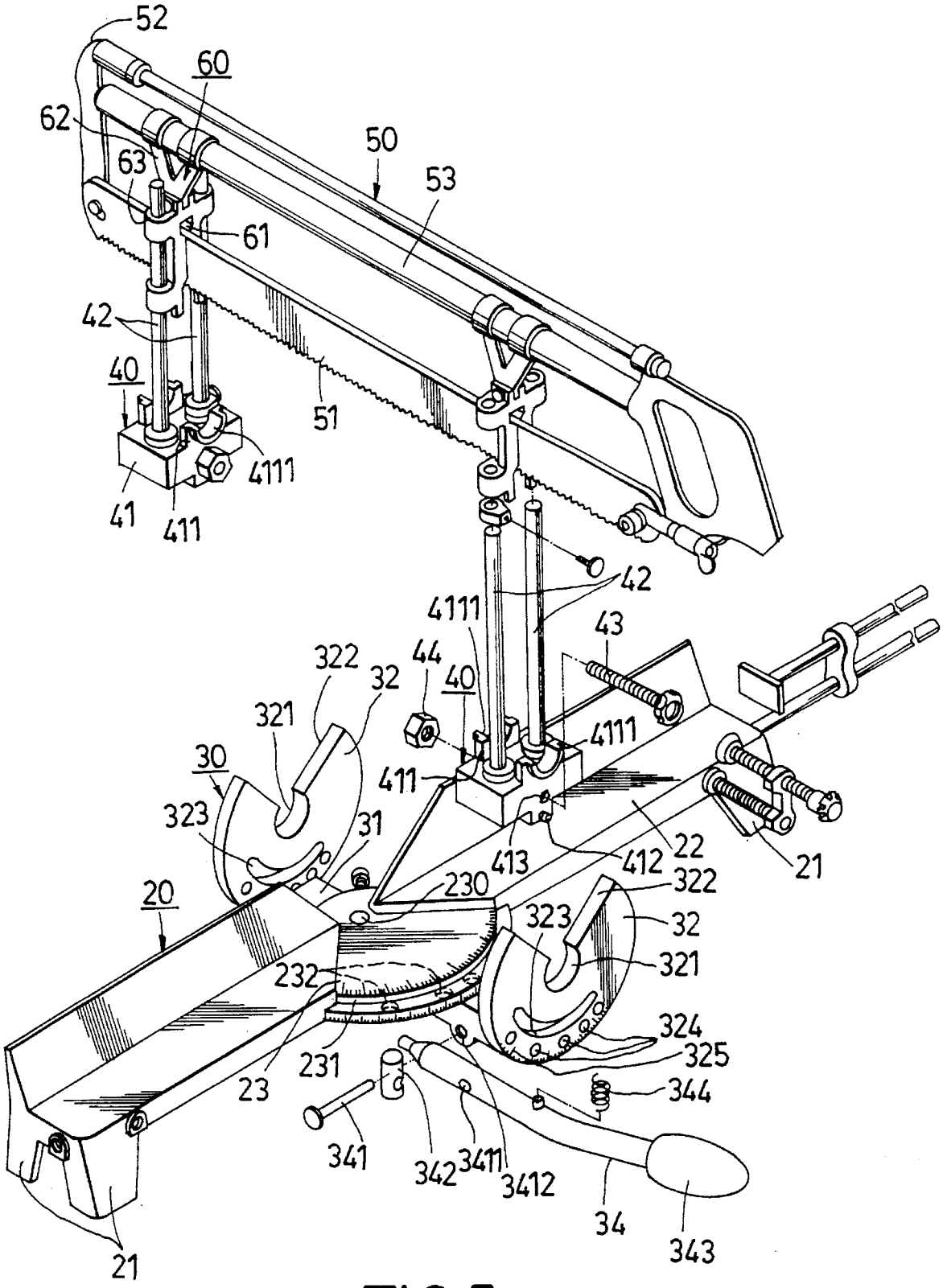
FIG. 5 is an exploded view showing the saw equipment according to the preferred embodiment of this invention.

Referring to FIG. 5, each of the positioning plates 32 has a generally V-shaped notch 322 which is formed in the upper end portion of the positioning plate 32 so as to allow the saw blade 51 of hacksaw 50 to be operated therein. The V-shaped notch 322 has a rounded tip portion 321. Five angularly equidistant engaging holes 324 are formed in each of the positioning plates 32 below the V-shaped notch 322 and are circumferentially aligned with each other. Each adjacent two of the engaging holes 324 are spaced apart from each other by an angle of 22.5°. A set of angle-measuring marks 325 is formed on each of the positioning plates 32 below the engaging holes 324 so as to indicate an angle of each of the engaging holes 324.

Figure 7:
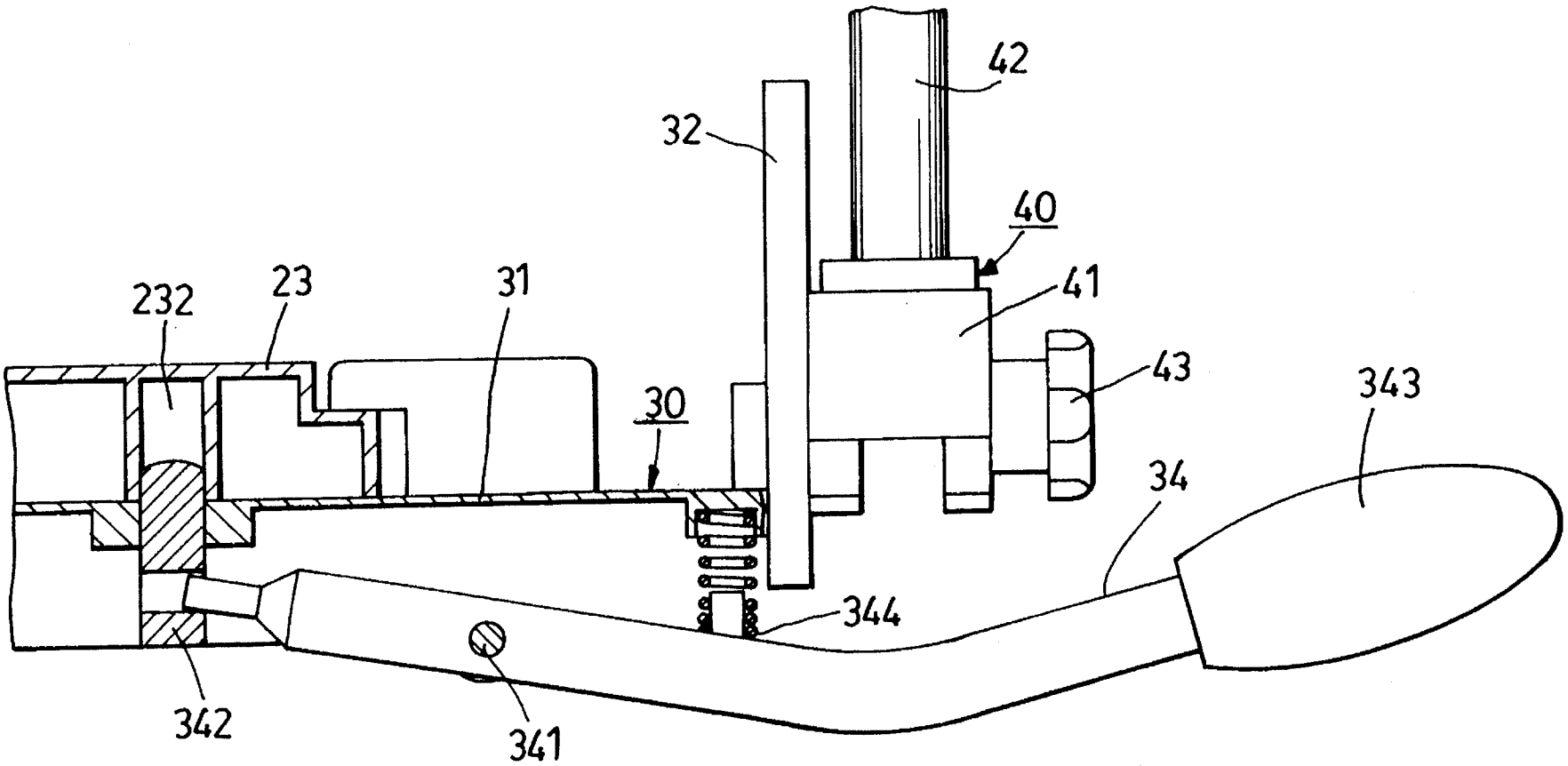
FIG. 7 is a schematic view illustrating a positioning assembly of the saw equipment of this invention.
Figure 8:
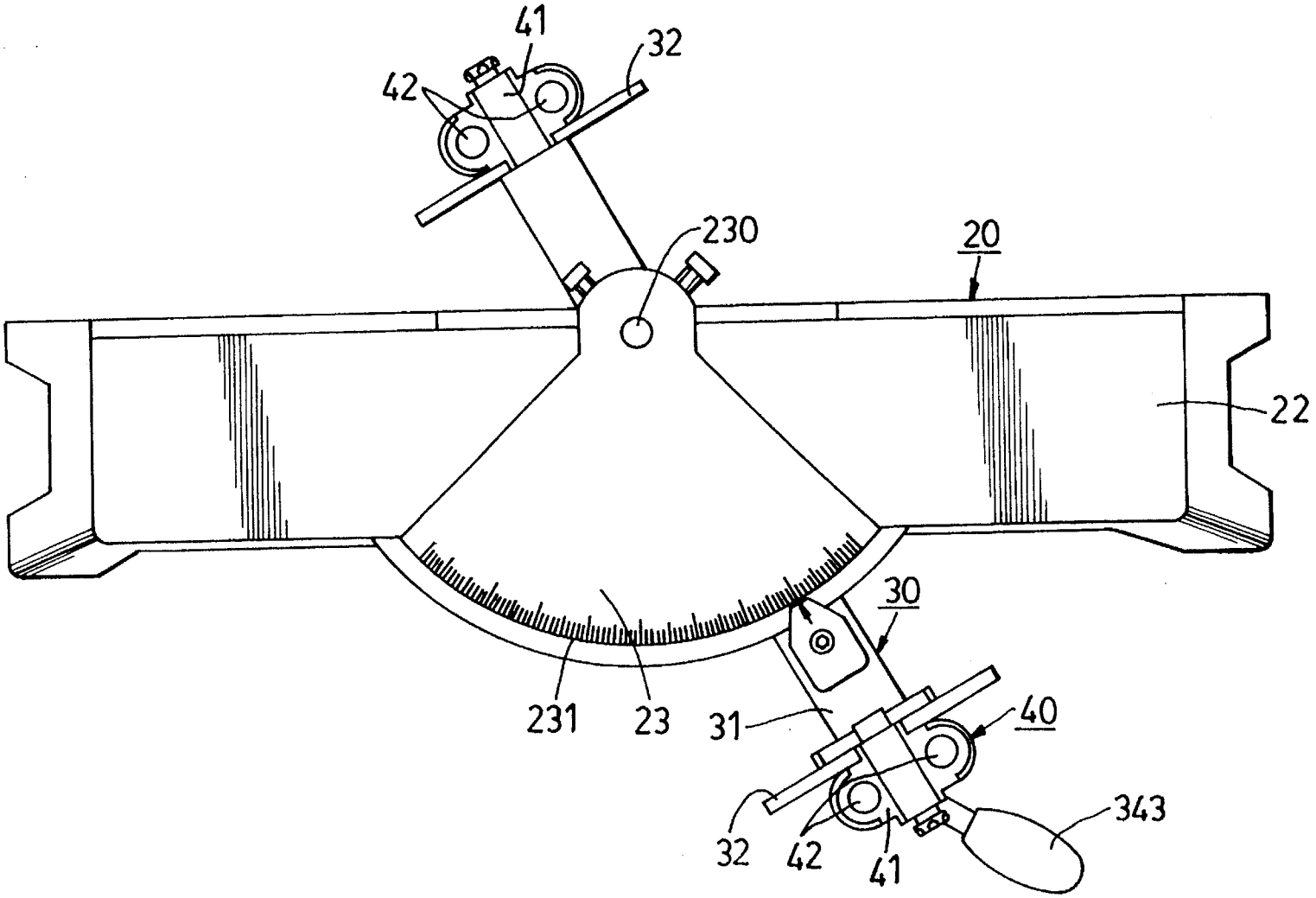
FIG. 8 is a schematic view illustrating the rotation of a rotary arm unit of the saw equipment in accordance with this invention.

The rotary arm unit 30 further includes a positioning assembly associated with the segmental plate 23 of the working table 20 and the rotary arm 31 of the rotary arm unit 30 for positioning the rotary arm 31 on the segmental plate 23. The positioning assembly, as shown in FIGS. 5 and 7, has a plurality of angularly equidistant positioning holes 232 formed in the bottom surface of the segmental plate 23 of the working table 20 and circumferentially aligned with each other, and an operating lever 34 which has a first end portion provided with a handle 343 and a second end portion provided with an engaging stud 342 to engage removably and selectively one of the positioning holes 232 (see FIG. 7). The operating lever 34 is connected pivotally to the rotary arm 31 by means of a pin 341 which extends through a pivot hole 3411 formed through the operating lever 34 so as to engage a hole 3412 formed in the rotary arm 31. The positioning assembly further has a bias unit for biasing the operating lever 34. The bias unit is a compression spring 344, as shown in FIG. 7, which is interposed between the bottom surface of the rotary arm 31 and the top surface of the operating lever 34 so as to maintain engagement of the engaging stud 342 within the corresponding positioning hole 232. The operating lever 34 is operable so as to push against the compression spring 344, thereby releasing the engaging stud 342 from the corresponding positioning hole 232 and permitting the rotary arm 31 to be horizontally rotated relative to the working table 20, as shown in FIG. 8.

Referring again to FIG. 4, each of the adjusting members 40 includes a lock block 41 with an inside wall movably contacting an outside wall of a respective one of the positioning plates 32, and two parallel rods 42 which extend upward from the top surface of the lock block 41. Referring again to FIG. 5, each of the lock blocks 41 has two engaging noses 412 (only one can be seen in the right lock block 41) which project respectively from the inside and outside walls of the lock block 41, and two retaining elements 411 which are secured respectively to the top ends of the inside and outside walls of the lock block 41 and which have semi-circular protrusions 4111. The engaging nose 412 located at the inside wall of the lock block 41 can engage removably and selectively one of the engaging holes 324 of the corresponding positioning plate 32. The protrusion 4111 of the retaining element 411 located at the inside wall of the lock block 41 can be laid on the round tip portion 321 of the V-shaped notch 322 of the corresponding positioning plate 32 so as to retain the lock blocks 41 on the positioning plates 32. Owing to the presence of two retaining elements 411 and two engaging noses on each of the lock blocks 41, each of the adjusting members 40 can be mounted freely on the right or left positioning plate 32 so as to facilitate replacement of the adjusting member 40 after long-term use.

Referring again to FIG. 5, each of the guide units 60 has a guide member which includes a vertically extending slot 61 formed in a lower portion thereof for receiving the saw blade 51 therein, an integral Upper sleeve portion 62 sleeved slidably on the horizontal bar 53 of the frame 52 for holding the frame 52 and guiding the saw blade 51 to reciprocate between the parallel rods 42 of the adjusting members 40 along a horizontal path, and two side sleeve portions 63 sleeved respectively and slidably on the parallel rods 42 of the corresponding guiding member 40 for guiding the saw blade 51 to reciprocate between the parallel rods 42 of the adjusting members 40 along a straight path.

The saw equipment further includes locking means for locking each of the adjusting members 40 releasably to a respective one of the positioning plates 32 of the rotary arm unit 30. Each of the locking means has an arcuate locking slot 323 formed through a respective one of the positioning plates 32 and radially spaced from the engaging holes 324 at a predetermined distance, a locking hole 413 formed through a respective one of the lock blocks 41 to be constantly aligned with the arcuate locking slot 323 at all adjusted inclining positions of the adjusting members 40 (see FIG. 6), a locking bolt 43 which extends through the locking hole 413 (see FIG. 4) and through the arcuate locking slot 323, and a locking nut 44 which engages the distal end portion of each of the locking bolts 43 for locking each of the lock blocks 41 on a respective one of the positioning plates 32, as shown in FIG. 4.

Figure 6:
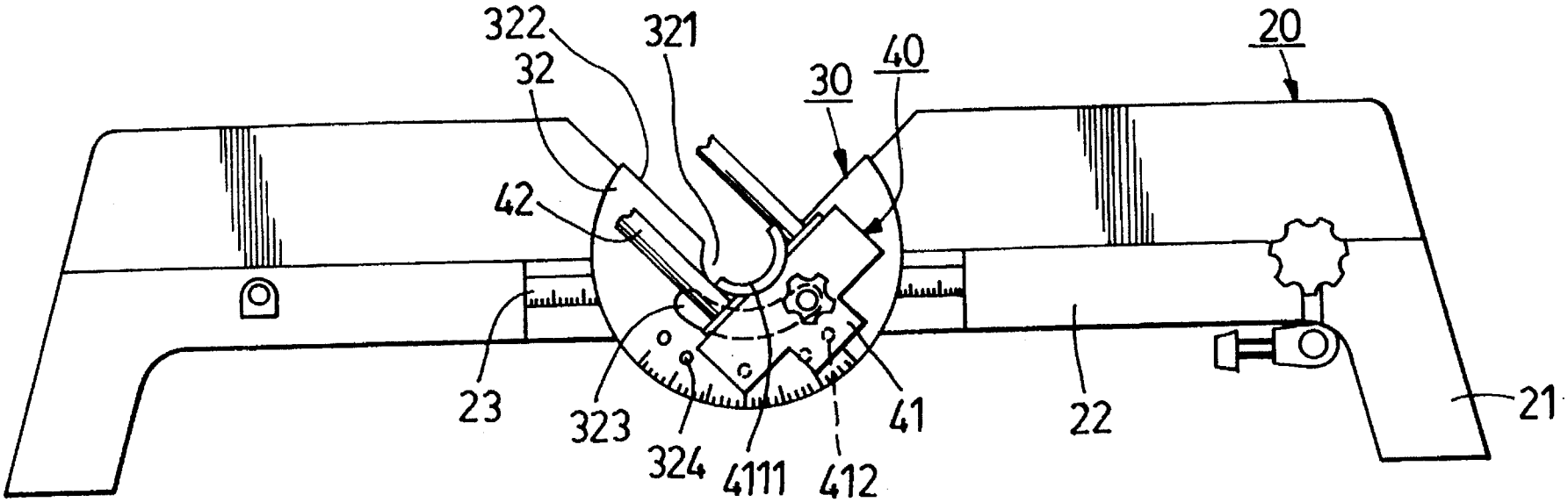
FIG. 6 is a schematic view illustrating the rotation of one of two adjusting members of the saw equipment in accordance with this invention.

When it is desired to adjust the inclining angle of the saw blade 51, as shown in FIG. 6, the locking nuts 44 are respectively disengaged from the locking bolts 43 so as to allow the locking bolts 43 to be pulled away from the arcuate locking slots 323 and the locking holes 413. At this time, the lock blocks 41 of the adjusting members 40 can be removed from the respective positioning plate 32 so that the user can adjust the location of the lock blocks 41 relative to positioning plates 32 by engaging the engaging nose 412 of each of the lock blocks 41 into another engaging hole 324 of a respective one of the positioning plates 32, thereby adjusting the inclining angle of the saw blade 51.

As a modified form of this invention, each of the positioning plates 32 can have seven angularly equidistant engaging holes formed therein and circumferentially aligned with each other. Each adjacent two of the engaging holes 324 are spaced apart from each other at an angle of 30°.

With this invention thus explained, it is apparent that numerous modifications and variations can be made without departing from the scope and spirit of this invention. It is therefore intended that this invention be limited only as indicated in the appended claims.

I claim:

1. A saw equipment comprising:

a working table having a segmental plate and a vertical rotary axis at a center of said segmental plate;

a rotary arm having an intermediate portion that is mounted rotatably on said vertical rotary axis, and two positioning plates which extend upward respectively from two end portions of said rotary arm, each of said positioning plates having a V-shaped notch at an upper side thereof, said V-shaped notch having a round tip portion, each of said positioning plates further having a plurality of engaging holes aligned at intervals, below said round tip portion, in the form of an arc substantially concentric with said round tip portion, and an arcuate locking slot concentric with said round tip portion and radially spaced from said arc of said engaging holes;

a hacksaw including a saw blade and a frame holding said saw blade;

two guide units for holding movably said frame above said working table, each of said guide units defining a slot for passage of said saw blade;

two adjusting members, each of which adjustably mounting each of said guide units to a respective one of said positioning plates, each of said adjusting members respectively having a lock block which is side-by-side adjacent to and turnably connected to a respective one of said positioning plates so as to adjust an inclining angle of the respective one of said guide units relative to said working table, each of said lock blocks having a protrusion to extend into said round tip portion for rotation therein, each of said lock blocks further having an integral engaging nose projecting therefrom to engage selectively one of said engaging holes, said integral engaging nose being movable between an engaging position and a disengaging position by moving said each of said lock blocks towards or away from an adjacent one of said positioning plates, and a locking hole to be constantly aligned with said arcuate locking slot; and a plurality of locking bolts, each of said locking bolts passing through one of said arcuate locking slots and a respective one of said aligned locking holes.

2. A saw equipment as claimed in claim 1, further comprising a plurality of locking nuts, each of said locking nuts engaging one of said locking bolts for locking one of said lock blocks on a respective one of said positioning plates.

3. A saw equipment as claimed in claim 1, further comprising a positioning assembly arranged below said segmental plate of said working table for positioning said rotary arm on said segmental plate, said positioning assembly having:

a plurality of angularly equidistant positioning holes formed in a bottom surface of said segmental plate of said working table, said positioning holes aligned about said vertical rotary axis;

an operating lever having a first end portion provided with a handle, and a second end portion provided with an engaging stud to engage removably and selectively one of said positioning holes, said operating lever being pivotally connected to said rotary arm at a location between said first and second end portions; and a bias unit for biasing said operating lever so as to maintain engagement of said engaging stud within said one of said positioning holes, said operating lever being operable so as to push against said biasing unit, thereby releasing said engaging stud from said one of said positioning holes and permitting rotation of said rotary arm.

4. A saw equipment as claimed in claim 1, wherein each of said guide units further comprises a pair of parallel rods which extend upward from each of said lock blocks to guide said saw blade therebetween.

5. A saw equipment as claimed in claim 1, wherein said frame of said hacksaw includes a horizontal bar extending between said guide units.

6. A saw equipment as claimed in claim 5, wherein each of said guide units further comprises:

a pair of parallel rods which extend upward from said lock block of said adjusting member to guide said saw blade therebetween; and a guide member, said guide member having a vertically extending slot formed therein for receiving said saw blade therein, an integral upper sleeve portion lying horizontally and sleeved slidably on said horizontal bar of said frame for guiding horizontal movement of said horizontal bar, and two side sleeve portions sleeved respectively and slidably on said parallel rods.

7. A saw equipment as claimed in claim 1, wherein each of said positioning plates has a set of angle-measuring marks formed thereon adjacent to said engaging holes of each of said positioning plates.

* * * * *